US009482116B2

(12) United States Patent
Hernandez Sanchez et al.

(10) Patent No.: US 9,482,116 B2
(45) Date of Patent: Nov. 1, 2016

(54) ACTIVE COLD-REHEAT TEMPERATURE CONTROL SYSTEM

(71) Applicant: General Electric Company, Schenectady, NY (US)

(72) Inventors: Nestor Hernandez Sanchez, Schenectady, NY (US); Kamlesh Mundra, Clifton Park, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 151 days.

(21) Appl. No.: 14/010,659

(22) Filed: Aug. 27, 2013

(65) Prior Publication Data

US 2015/0059343 A1 Mar. 5, 2015

(51) Int. Cl.
*F01K 7/22* (2006.01)
*F01K 7/24* (2006.01)

(52) U.S. Cl.
CPC ..... *F01K 7/24* (2013.01)

(58) Field of Classification Search
CPC ..... F01K 7/02; F01K 7/04; F01K 7/025; F01K 7/24; F01K 7/22; F01K 13/02; F01D 11/06; F01D 11/10; F05B 2240/40
USPC ..... 60/679, 646, 677, 660–663
See application file for complete search history.

(56) References Cited

U.S. PATENT DOCUMENTS 3,604,206 A * 9/1971 Baily ..... 60/644.1
4,316,362 A * 2/1982 Ninomiya et al. ..... 60/646
4,589,255 A 5/1986 Martens et al.
4,693,086 A * 9/1987 Hoizumi et al. ..... 60/663
5,018,356 A 5/1991 Silvestri, Jr. et al.
7,668,623 B2 2/2010 Kephart et al.
2008/0302102 A1 12/2008 Cheng et al.
2009/0217665 A1* 9/2009 Holzhauer ..... F01D 17/00 60/645
2012/0240589 A1* 9/2012 Tateishi et al. ..... 60/772
2012/0255303 A1* 10/2012 Labbe ..... F01K 7/40 60/653
2014/0165565 A1* 6/2014 Shindo ..... 60/646

* cited by examiner

*Primary Examiner* — Audrey K Bradley
*Assistant Examiner* — Kelsey Stanek
(74) *Attorney, Agent, or Firm* — Ernest G. Cusick; Hoffman Warnick LLC

(57) ABSTRACT

Various embodiments of the invention include systems for controlling cold-reheat extraction in a turbomachine system. Some embodiments include a system having: a high-pressure (HP) turbine section including an exhaust; a reheater conduit fluidly connected with the exhaust of the HP turbine and a reheater, the reheater conduit for passing HP exhaust steam from the HP turbine section to the reheater; a cold-reheat extraction conduit fluidly connected with the reheater conduit upstream of the reheater and downstream of the HP turbine section exhaust; and a control system coupled with the HP turbine section and the cold-reheat extraction conduit, the control system configured to: obtain data about a temperature of the HP exhaust steam; and provide instructions to modify a flow rate of the HP exhaust steam to the reheater in response to the temperature of the HP exhaust steam exceeding a threshold.

20 Claims, 1 Drawing Sheet

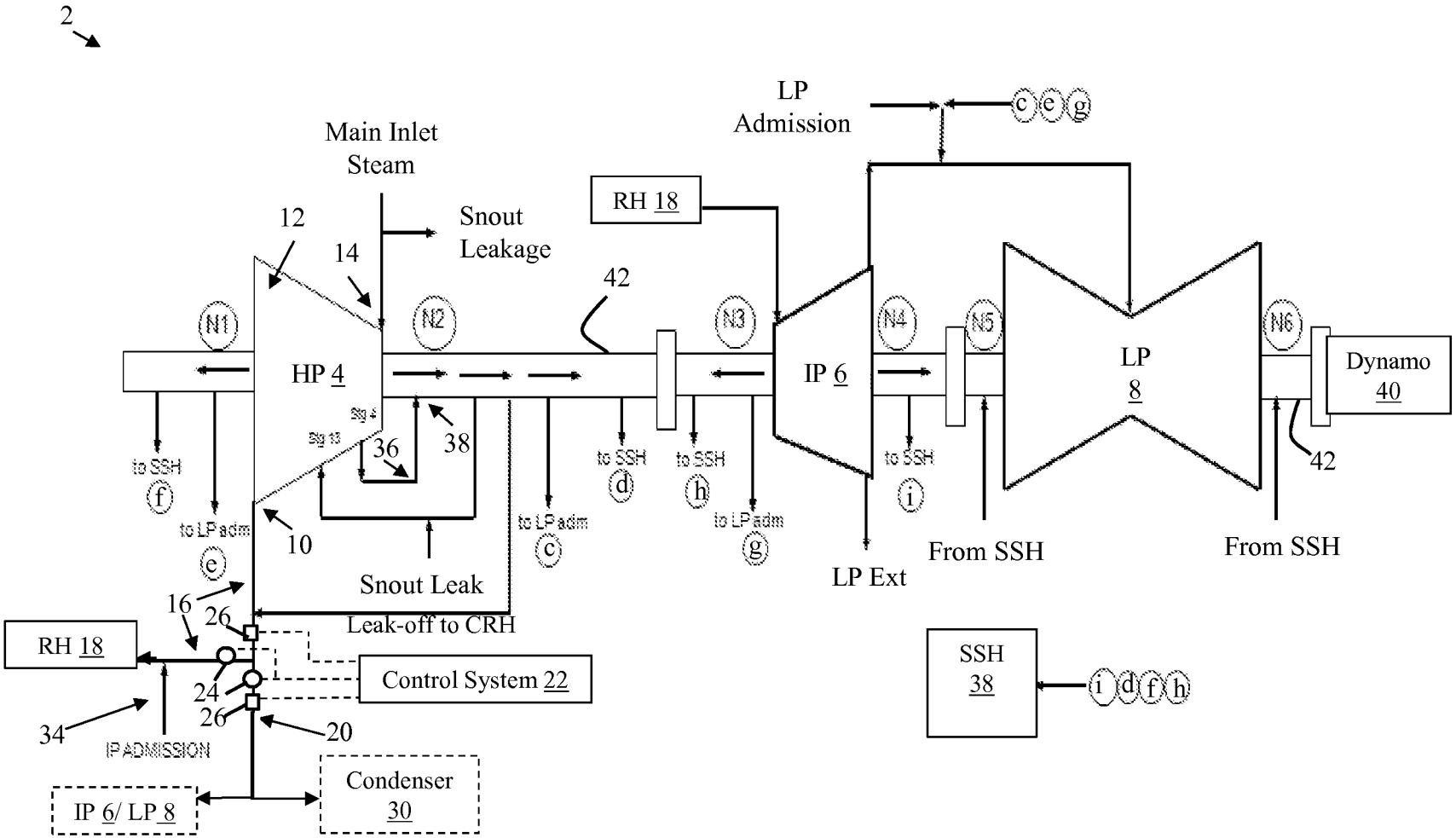
Dynamo
40
42
From SSH
LP
8
From SSH
LP Ext
SSH
38
LP
Admission
IP 6
RH 18
Snout
Leakage
Main Inlet
Steam
HP 4
Snout Leak
Leak-off to CRH
Control System 22
Condenser
30
IP ADMISSION
IP 6/ LP 8
RH 18
2
10
12
14
16
20
24
26
34
36
38
42
N1
N2
N3
N4
N5
N6
to SSH
to LP adm
c
d
e
f
g
h
i

ACTIVE COLD-REHEAT TEMPERATURE CONTROL SYSTEM

FIELD OF THE INVENTION

The subject matter disclosed herein relates to turbomachines and related control systems. Specifically, the subject matter disclosed herein relates to steam turbomachines and related control systems.

BACKGROUND OF THE INVENTION

Turbomachines, such as steam turbines, are designed to operate across a range of load conditions to produce power, e.g., for supplying a power grid. However, turbomachines (e.g., steam turbines) are ultimately rated to operate at a desired (target) load condition where the turbomachine is most efficient. Due to varying output requirements, these turbomachines cannot always function at their desired (target) load condition. As such, many turbomachines spend time running at part-load, low-part-load and/or low-load conditions, each of which is a fraction of the desired load for that turbomachine.

At these lower load conditions, components in the turbomachine can endure higher than desired temperatures. These temperature conditions can force design engineers to user higher-strength (higher-cost) materials in the turbomachine, leading to higher overall system costs.

BRIEF DESCRIPTION OF THE INVENTION

Various embodiments of the invention include systems for controlling cold-reheat extraction in a turbomachine system. Some embodiments include a system having: a high-pressure (HP) turbine section including an exhaust; a reheater conduit fluidly connected with the exhaust of the HP turbine and a reheater, the reheater conduit for passing HP exhaust steam from the HP turbine section to the reheater; a cold-reheat extraction conduit fluidly connected with the reheater conduit upstream of the reheater and downstream of the HP turbine section exhaust; and a control system coupled with the HP turbine section and the cold-reheat extraction conduit, the control system configured to: obtain data about a temperature of the HP exhaust steam; and provide instructions to modify a flow rate of the HP exhaust steam to the reheater in response to the temperature of the HP exhaust steam exceeding a threshold.

A first aspect of the invention includes a system having: a high-pressure (HP) turbine section including an exhaust; a reheater conduit fluidly connected with the exhaust of the HP turbine and a reheater, the reheater conduit for passing HP exhaust steam from the HP turbine section to the reheater; a cold-reheat extraction conduit fluidly connected with the reheater conduit upstream of the reheater and downstream of the HP turbine section exhaust; and a control system coupled with the HP turbine section and the cold-reheat extraction conduit, the control system configured to: obtain data about a temperature of the HP exhaust steam; and provide instructions to modify a flow rate of the HP exhaust steam to the reheater in response to the temperature of the HP exhaust steam exceeding a threshold.

A second aspect of the invention includes a system having: a dynamoelectric machine; a high-pressure (HP) turbine section coupled with the dynamoelectric machine, the HP turbine section including an exhaust; a reheater conduit fluidly connected with the exhaust of the HP turbine and a reheater, the reheater conduit for passing HP exhaust steam from the HP turbine section to the reheater; an intermediate pressure (IP) turbine section fluidly connected with the reheater; a cold-reheat extraction conduit fluidly connected with the reheater conduit upstream of the reheater and downstream of the HP turbine section exhaust; and a control system coupled with the HP turbine section and the cold-reheat extraction conduit, the control system configured to: obtain data about a temperature of the HP exhaust steam; and provide instructions to modify a flow rate of the HP exhaust steam to the reheater in response to temperature of the HP exhaust steam deviating from a threshold range.

A third aspect of the invention includes a system having: a dynamoelectric machine; a high-pressure (HP) turbine section coupled with the dynamoelectric machine, the HP turbine section including an exhaust; a reheater conduit fluidly connected with the exhaust of the HP turbine and a reheater, the reheater conduit for passing HP exhaust steam from the HP turbine section to the reheater; an intermediate pressure (IP) turbine section fluidly connected with the reheater; a cold-reheat extraction conduit fluidly connected with the reheater conduit upstream of the reheater and downstream of the HP turbine section exhaust; at least one temperature sensor coupled with the reheater conduit or the cold-reheat extraction conduit, the at least one temperature sensor for detecting a temperature of the HP exhaust steam; and a control system coupled with the at least one temperature sensor and the cold-reheat extraction conduit, the control system configured to: obtain data about the temperature of the HP exhaust steam; and provide instructions to modify a flow rate of the HP exhaust steam to the reheater in response to the temperature of the HP exhaust steam exceeding a threshold.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which:

FIG. 1 shows a schematic diagram of a system according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted herein, the subject matter disclosed herein relates to turbomachines and related control systems. Specifically, the subject matter disclosed herein relates to steam turbomachines and related control systems.

As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference which surrounds axis A but does not intersect the axis A at any location.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

As noted herein, turbomachines, e.g., steam turbine systems, frequently operate across a spectrum of load conditions. At lower load conditions, components in the turbomachine can endure higher than desired temperatures. For example, in a combined cycle steam turbine system having a high-pressure (HP) section, intermediate pressure (IP) section, low pressure (LP) section and a reheater (e.g., heat recovery steam generator, or HRSG), lower load conditions (e.g., below rated/target load conditions) can cause the cold reheat steam to experience high temperature conditions. These temperature conditions can require designs that utilized high-cost materials in the reheater, contributing to increased cost in the turbomachine system.

As is known in the art, the fluid flow downstream of the HP section exhaust and upstream of the reheater is sometimes referred to as "cold reheat" fluid (which has not been reheated), whereas fluid leaving the reheater, upstream of the IP section inlet, is sometimes referred to as "hot reheat" fluid (which has been reheated). The hot reheat temperature is conventionally controlled by an attemperation system, as is known in the art.

As is known in the art, the term "cold-reheat temperature" in a steam turbine refers to the temperature of steam exiting the HP turbine section. This cold-reheat steam is then provided to a reheater (e.g., an HRSG) that can be used to reheat the steam for use in another turbine section (e.g., an IP and/or LP turbine section). Reheaters are conventionally designed to handle a range of temperature conditions, which vary according to the load on the turbomachine system. As noted herein, materials that can withstand this range of temperature conditions are typically expensive, and can contribute significantly to the costs of the turbomachine.

In contrast to conventional systems, various embodiments of the invention include a cold-reheat temperature control system that controls the amount of steam extracted from the HP section exhaust, and thus, the cold-reheat temperature. By controlling this temperature of the steam entering the reheater, it is possible to utilize more cost-effective materials in the reheater, and reduce overall system costs.

In various embodiments, a system includes a cold-reheat extraction conduit fluidly connected with the HP extraction conduit, and a control system operably connected with that cold-reheat extraction conduit. The control system can be configured to initiate extraction of HP exhaust steam from the HP extraction conduit, and introduce that extracted HP exhaust steam directly to the condenser (or, alternatively, to the IP section and/or LP section). In various embodiments, the system can include temperature measurement devices coupled with the control system. The temperature measurement devices can detect a temperature of the HP exhaust steam (e.g., in the HP extraction conduit), and the control system can obtain this temperature information (e.g., from the temperature measurement devices and/or an intermediary such as a data store). The control system can compare the temperature information with one or more thresholds (e.g., single temperature threshold, or a range of temperatures having an upper and lower bound) to determine whether to extract the HP exhaust steam (and how much) in order to lower the temperature of the inlet steam to the reheater.

In practice, drawing steam from the HP extraction conduit (also referred to as the reheater supply flow) drops the pressure in that conduit, which thereby drops the temperature of the reheater supply flow. This allows for use of materials such as carbon-steel in the reheater, where conventional systems may not allow for use of such materials.

Various particular embodiments include a system having: a high-pressure (HP) turbine section including an exhaust; a reheater conduit fluidly connected with the exhaust of the HP turbine and a reheater, the reheater conduit for passing HP exhaust steam from the HP turbine section to the reheater; a cold-reheat extraction conduit fluidly connected with the reheater conduit upstream of the reheater and downstream of the HP turbine section exhaust; and a control system coupled with the HP turbine section and the cold-reheat extraction conduit, the control system configured to: obtain data about a temperature of the HP exhaust steam; and provide instructions to modify a flow rate of the HP exhaust steam to the reheater in response to the temperature of the HP exhaust steam exceeding a threshold.

Various additional embodiments include a system having: a dynamoelectric machine; a high-pressure (HP) turbine section coupled with the dynamoelectric machine, the HP turbine section including an exhaust; a reheater conduit fluidly connected with the exhaust of the HP turbine and a reheater, the reheater conduit for passing HP exhaust steam from the HP turbine section to the reheater; an intermediate pressure (IP) turbine section fluidly connected with the reheater; a cold-reheat extraction conduit fluidly connected with the reheater conduit upstream of the reheater and downstream of the HP turbine section exhaust; and a control system coupled with the HP turbine section and the cold-reheat extraction conduit, the control system configured to: obtain data about a temperature of the HP exhaust steam; and provide instructions to modify a flow rate of the HP exhaust steam to the temperature of the HP exhaust steam deviating from a threshold temperature range (e.g., falling above an upper end of the range or falling below a lower end of the range).

Various other embodiments include a system having: a dynamoelectric machine; a high-pressure (HP) turbine section coupled with the dynamoelectric machine, the HP turbine section including an exhaust; a reheater conduit fluidly connected with the exhaust of the HP turbine and a reheater, the reheater conduit for passing HP exhaust steam from the HP turbine section to the reheater; an intermediate pressure (IP) turbine section fluidly connected with the reheater; a cold-reheat extraction conduit fluidly connected with the reheater conduit upstream of the reheater and downstream of the HP turbine section exhaust; at least one temperature sensor coupled with the reheater conduit or the cold-reheat extraction conduit, the at least one temperature sensor for detecting a temperature of the HP exhaust steam; and a control system coupled with the at least one temperature sensor and the cold-reheat extraction conduit, the control system configured to: obtain data about the temperature of the HP exhaust steam; and provide instructions to modify a flow rate of the HP exhaust steam to the reheater in response to the temperature of the HP exhaust steam exceeding a threshold.

Turning to FIG. 1, a system 2 is shown according to various embodiments. The system 2 can include a multi-section turbine system, for example, a combined-cycle turbine system including one or more steam turbines, at least one gas turbine, and a dynamoelectric machine (e.g., generator) coupled with at least one of the turbines.

More particularly, the system 2 can include a high-pressure (HP) turbine section 4, an intermediate pressure (IP) turbine section 6, and a low pressure (LP) turbine section 8. The LP turbine section 8 is depicted in this example as a double-flow LP steam turbine, however, it is understood that the LP turbine section 8 may take other conventional forms not depicted herein (e.g., an axial flow steam turbine, or a multiple flow LP steam turbine). Each of these turbine sections (HP, IP and/or LP) may be fluidly connected with one another, and can be mechanically coupled via one or more rotatable shafts, as is known in the art.

The HP turbine section 4 can include an exhaust 10 located proximate a last stage (or, end stage) 12 of the HP turbine section 4. The exhaust 10 is located downstream of the HP turbine section's inlet 14 (or, main steam inlet). After high-pressure steam has passed axially through the HP turbine section 4 and performed mechanical work, it exits the exhaust 10. The system 2 further includes a reheater conduit 16 fluidly connected with the exhaust 10, and a reheater (RH) 18. The reheater (cold reheat) conduit 16 is designed to pass HP exhaust steam from the HP turbine section 4 to the reheater 18 (hot reheat), for use in other turbine sections, e.g., IP turbine section 6 and/or LP turbine section 8. In various embodiments, the reheater 18 may be any conventional re-heater used in a power plant, such as one that uses tubes and hot flue gases to provide heat energy to steam fed through the tubes. In some cases, the reheater 18 includes a conventional heat recovery steam generator (HRSG), which transfers heat from gas turbine exhaust to steam exhaust in order to raise the temperature of that exhaust and allow for use of the heated steam exhaust in another turbine section (e.g., IP turbine section 6 and/or LP turbine section 8). As used herein, a "conduit" may include any conventional conduit used to carry steam in a steam turbine system, e.g., ducts or pipes made in part from metal, composite, polymers, etc.

Also shown, the system 2 can include a cold-reheat extraction conduit 20 fluidly connected with the reheater conduit 16, upstream of the reheater 18 and downstream of the exhaust 10. The cold-reheat extraction conduit 20 can be used to extract HP exhaust steam from the reheater conduit 16 prior to that steam reaching the reheater 18, which can cool the steam entering the reheater 18, thereby allowing for use of materials such as carbon-steel in components within the reheater 18.

As used herein, the terms "upstream" and "downstream" refer to the relative position of components with respect to the flow of a working fluid, e.g., steam or gas, through a conduit, component, etc. For example, a first position is upstream of a second position if it is closer to the inlet of a device (e.g., a turbine) than the second position. In another example, fluid flows from upstream to downstream in a conduit, as indicated by arrows indicating the direction of that fluid flow.

Additionally, the system 2 can include a control system 22 coupled with the HP turbine section 4 and the cold-reheat extraction conduit 20. The control system 22 can be configured to perform processes such as: 1) obtaining (e.g., receiving) data about a temperature of the HP exhaust steam (from the HP turbine section 4); and b) providing instructions to modify a flow rate of the HP exhaust steam to the reheater 18 in response to temperature of the HP exhaust steam deviating from a threshold range. In various embodiments, the threshold can include a threshold temperature value, and when the temperature of the HP exhaust steam exceeds that value, the control system 22 provides instructions to increase extraction flow from the reheater conduit 16 via the cold-reheat extraction conduit 20. In other embodiments, the threshold can include a threshold temperature value, and when the temperature of the HP exhaust steam drops below that value, the control system 22 provides instructions to reduce the amount of HP exhaust steam extracted from the reheater conduit 16 via the cold-reheat extraction conduit 20. In some cases, the threshold includes a range, e.g., a high temperature value and a low temperature value, and the control system 22 is configured to provide instructions to modify extraction of the HP exhaust steam (via cold-reheat extraction conduit 20) when the temperature of the HP exhaust steam falls outside of the high temperature value or the low temperature value.

The system 2 can further include a valve 24 coupled to the control system 22 and the cold reheat extraction conduit 20. The valve 24 can be configured to initiate modifying of the flow rate of the HP exhaust steam to the reheater 18 by modifying a flow rate of the HP exhaust steam through the cold-reheat extraction conduit 20. Valve 24 may have an open position and a closed position, wherein the closed position prevents flow of the HP exhaust steam into the cold-reheat extraction conduit 20. Valve 24 may be, for example, two-way valves. As is known in the art of fluid mechanics, a two-way valve either prevents a portion of the flow of a working fluid through a pathway, or allows a portion of that flow to pass. Valve 24 may primarily function in a closed position (total obstruction), and can be actuated to function in an open position (no obstruction). However, valve 24 may also function in a partially open position (partial obstruction). Valve 24 may, for example, be a gate valve, a butterfly valve, a globe valve, etc.

In various embodiments, the system 2 also includes at least one temperature sensor 26 coupled with the reheater conduit 16 or the cold-reheat extraction conduit 20. The temperature sensor(s) 26 can detect a temperature of the HP exhaust steam, in the reheater conduit 16 and/or the cold-reheat extraction conduit 20. In various embodiments, the temperature sensor(s) 26 are connected with the control system 22, and can provide temperature data about the temperature of the HP exhaust steam to the control system 22 on a rolling basis, on demand, or in any other manner. The temperature sensor(s) 26 can further provide temperature data about the HP exhaust steam to an intermediary, e.g., a data store, which the control system 22 can access to determine a temperature of the HP exhaust steam.

The control system 22 can be mechanically or electrically connected to the valve 24 such that control system 22 may actuate the valve 24, e.g., actuate at least partially opening or at least partially closing of the valve 24. The control system 22 can actuate the valve 24 in response to a load change on the HP turbine section 4 (and similarly, a load change on system 2). The control system 22 may be a computerized, mechanical, or electro-mechanical device capable of actuating valves (e.g., valve 24). In one embodiment control system 22 may be a computerized device capable of providing operating instructions to valve 24. In this case, control system 22 may monitor the load of HP turbine section 4 (e.g., via electrical output from dynamoelectric machine 40) by monitoring the temperature steam passing through the reheater conduit 16 (as well as through the HP turbine section 4, IP turbine section 6 and/or LP turbine section 8), and provide operating instructions to the valve 24 based upon the load. For example, control system 22 may send operating instructions to open valve 24 under certain operating conditions (e.g., to allow flow of HP exhaust steam through the cold-reheat extraction conduit 20 in order to reduce the temperature of the exhaust steam reaching the reheater 16). In this embodiment, valve 24 may include electro-mechanical components, capable of receiving operating instructions (electrical signals) from control system 22 and producing mechanical motion (e.g., partially opening valve 24). In another embodiment, control system 22 may include a mechanical device, capable of use by an operator. In this case, the operator may physically manipulate control system 22 (e.g., by pulling a lever), which may actuate valve 24. For example, the lever of control system 22 may be mechanically linked to valve 24, such that pulling the lever causes the first valve 24 to fully actuate (e.g., by opening the flow path through the cold-reheat extraction conduit 20). In another embodiment, control system 22 may be an electro-mechanical device, capable of electrically monitoring (e.g., with sensors) parameters (e.g., steam temperature) indicating the HP turbine section 4 is running at a certain load condition (e.g., a part load condition), and mechanically actuating valve 24. While described in several embodiments herein, control system 22 may actuate the valve 24 through any other conventional means.

In various embodiments, as described herein, the control system 22 can be configured (e.g., programmed or otherwise configured) to actuate the valve 24 in response to determining that the HP turbine section 4 is operating at a part-load condition. In various embodiments, the "part-load condition" is defined as approximately 10 percent to approximately ninety-five (95) percent of a rated operating load for the HP turbine section 4. That is, in response to determining that the HP turbine section 4 is operating at approximately 10 percent to approximately 95 percent of its rated operating load, the control system 22 will at least partially actuate the valve 24 to allow flow of HP exhaust steam through the cold-reheat extraction conduit 20. However, in various other embodiments, the control system 22 can be configured to actuate the valve 24 during conditions other than part-load conditions.

In various embodiments described herein, the control system 22 is configured to provide instructions to modify the flow rate of the HP exhaust steam to the reheater 16 in response to the temperature of the HP exhaust steam exceeding a threshold (where the temperature data is provided by temperature sensors 26). In some cases, the threshold is a temperature threshold that corresponds to a load condition on the HP turbine section 4, described further herein.

As shown, in some cases, the system 2 can further include a condenser 30 fluidly connected with the cold-reheat extraction conduit 20. The condenser 30 is shown in phantom as being optionally connected with the cold-reheat extraction conduit 20, because, in some cases, the cold-reheat extraction conduit 20 is fluidly connected with one or both of the IP turbine section 6 or the LP turbine section 8.

In some embodiments, the system 2 further includes an IP section admission conduit 34 fluidly connected with the reheater conduit 16 downstream (farther down the flow path) of the cold-reheat extraction conduit 20. The IP turbine section admission conduit 34 can supply IP admission steam to the reheater 18 prior to introduction of that steam to the IP turbine section 8 (where the reheater 18 is fluidly connected with the IP turbine section 8).

As shown, the HP turbine section 4 can further include a steam seal header (SSH) conduit 36 upstream of the reheater conduit 16 (closer to the inlet of the HP turbine section 4). The SSH conduit 36 can supply extracted steam from the HP turbine section 4 to a steam seal header 38 proximate the HP turbine section 4. As is known in the art, the steam seal header 38 can provide an axial steam seal between the HP turbine section 4 and the rotating shaft of that turbine section.

Further, the system 2 can include a dynamoelectric machine (e.g., a generator and/or electric motor) 40 mechanically coupled with at least one of the HP turbine section 4, IP turbine section 6 or LP turbine section 8. The dynamoelectric machine 40 can translate the rotational motion of the shaft(s) from the turbine section(s) into electrical energy, as is known in the art.

Also shown in turbine system 2 is a shaft 42, on which at least one of the HP steam turbine 4, IP steam turbine 6, LP steam turbine 8 and/or dynamoelectric machine 40 may be positioned. It is understood that the shaft 42 depicted herein may in actuality include a series of shafts coupled using one or more conventional coupling elements, as is known in the art. As is known in the art and described herein, the steam turbines may be individually or collectively coupled to a driven machine (e.g., an electrical generator for the purpose of generating electricity, or any other type of mechanically driven machine such as a compressor or pump). Additionally, the flow of fluid (e.g., steam) across the surface of shaft 42 is indicated by arrows pointing either axially upstream, downstream or sideways.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A system comprising:

a high-pressure (HP) turbine section including an exhaust;

a reheater conduit fluidly connected with the exhaust of the HP turbine and a reheater, the reheater conduit for passing HP exhaust steam from the HP turbine section to the reheater;

a cold-reheat extraction conduit fluidly connected with the reheater conduit upstream of the reheater and downstream of the HP turbine section exhaust; and a control system coupled with the HP turbine section and the cold-reheat extraction conduit, the control system configured to:

obtain data about a temperature of the HP exhaust steam from the HP turbine section via at least one temperature sensor; and modify a flow rate of the HP exhaust steam to the reheater in response to the temperature of the HP exhaust steam exceeding a threshold during steady-state loads of the HP turbine section.

2. The system of claim 1, wherein the at least one temperature sensor is coupled with the reheater conduit or the cold-reheat extraction conduit.

3. The system of claim 1, further comprising a valve coupled to the control system and the cold reheat extraction conduit, the valve configured to initiate the modifying of the flow rate of the HP exhaust steam to the reheater by modifying a flow rate of the HP exhaust steam through the cold-reheat extraction conduit.

4. The system of claim 1, further comprising a condenser, wherein the cold-reheat extraction conduit is fluidly connected with the condenser.

5. The system of claim 1, further comprising at least one of intermediate pressure (IP) turbine section or a low pressure (LP) turbine section, wherein the cold-reheat extraction conduit is fluidly connected with the at least one of the IP turbine section or the LP turbine section.

6. The system of claim 1, further comprising an intermediate pressure (IP) turbine section admission conduit fluidly connected with the reheater conduit downstream of the cold-reheat extraction conduit, the IP turbine section admission conduit for supplying IP admission steam to the reheater.

7. The system of claim 1, further comprising an IP turbine section fluidly connected with the reheater.

8. The system of claim 1, wherein the HP turbine section further includes a steam seal header (SSH) conduit upstream of the reheater conduit, the SSH conduit for supplying extracted steam from the HP turbine section to a steam seal header proximate the HP turbine section.

9. The system of claim 1, further comprising a dynamoelectric machine coupled with the HP turbine section.

10. The system of claim 1, wherein the reheater includes a heat recovery steam generator (HRSG).

11. A system comprising:

a dynamoelectric machine;

a high-pressure (HP) turbine section coupled with the dynamoelectric machine, the HP turbine section including an exhaust;

a reheater conduit fluidly connected with the exhaust of the HP turbine and a reheater, the reheater conduit for passing HP exhaust steam from the HP turbine section to the reheater;

an intermediate pressure (IP) turbine section fluidly connected with the reheater;

a cold-reheat extraction conduit fluidly connected with the reheater conduit upstream of the reheater and downstream of the HP turbine section exhaust; and a control system coupled with the HP turbine section and the cold-reheat extraction conduit, the control system configured to:

obtain data about a temperature of the HP exhaust steam from the HP turbine section via at least one temperature sensor; and actuate a valve to modify a flow rate of the HP exhaust steam to the reheater in response to the temperature deviating from a threshold range during steady-state loads of the HP turbine section.

12. The system of claim 11, wherein the at least one temperature sensor is coupled with the reheater conduit or the cold-reheat extraction conduit, wherein the control system is configured to provide the instructions to modify the flow rate of the HP exhaust steam to the reheater in response to the temperature of the HP exhaust steam deviating from the threshold range.

13. The system of claim 11, further comprising a valve coupled to the control system and the cold reheat extraction conduit, the valve configured to initiate the modifying of the flow rate of the HP exhaust steam to the reheater by modifying a flow rate of the HP exhaust steam through the cold-reheat extraction conduit.

14. The system of claim 11, further comprising a condenser, wherein the cold-reheat extraction conduit is fluidly connected with the condenser.

15. The system of claim 11, further comprising at least one of intermediate pressure (IP) turbine section or a low pressure (LP) turbine section, wherein the cold-reheat extraction conduit is fluidly connected with the at least one of the IP turbine section or the LP turbine section.

16. The system of claim 11, further comprising an intermediate pressure (IP) turbine section admission conduit fluidly connected with the reheater conduit downstream of the cold-reheat extraction conduit, the IP turbine section admission conduit for supplying IP admission steam to the reheater.

17. A system comprising:

a dynamoelectric machine;

a high-pressure (HP) turbine section coupled with the dynamoelectric machine, the HP turbine section including an exhaust;

a reheater conduit fluidly connected with the exhaust of the HP turbine and a reheater, the reheater conduit for passing HP exhaust steam from the HP turbine section to the reheater;

an intermediate pressure (IP) turbine section fluidly connected with the reheater;

a cold-reheat extraction conduit fluidly connected with the reheater conduit upstream of the reheater and downstream of the HP turbine section exhaust;

at least one temperature sensor coupled with the reheater conduit or the cold-reheat extraction conduit, the at least one temperature sensor for detecting a temperature of the HP exhaust steam; and a control system coupled with the at least one temperature sensor and the cold-reheat extraction conduit, the control system configured to:

obtain data about the temperature of the HP exhaust steam from the HP turbine section via the at least one temperature sensor; and modify a flow rate of the HP exhaust steam to the reheater in response to the temperature of the HP exhaust steam exceeding a threshold during steady-state loads of the HP turbine section.

18. The system of claim 17, further comprising a valve coupled to the control system and the cold-reheat extraction conduit, the valve configured to initiate the modifying of the flow rate of the HP exhaust steam to the reheater by modifying a flow rate of the HP exhaust steam through the cold-reheat extraction conduit.

19. The system of claim 17, further comprising a condenser, wherein the cold-reheat extraction conduit is fluidly connected with the condenser.

20. The system of claim 17, further comprising at least one of intermediate pressure (IP) turbine section or a low pressure (LP) turbine section, wherein the cold-reheat extraction conduit is fluidly connected with the at least one of the IP turbine section or the LP turbine section.

* * * * *